US010697147B2

(12) United States Patent
Cascarino et al.

(10) Patent No.: US 10,697,147 B2
(45) **Date of Patent: *Jun. 30, 2020**

(54) DRILLING MACHINE

(71) Applicant: SOLETANCHE FREYSSINET, Rueil-Malmaison (FR)

(72) Inventors: Sara Cascarino, Rueil-Malmaison (FR); Daniel Perpezat, Rueil-Malmaison (FR); Laurent Pivert, Rueil-Malmaison (FR); Régis Bernasinski, Rueil-Malmaison (FR)

(73) Assignee: SOLETANCHE FREYSSINET, Rueil Malmaison (FR)

( * ) Notice: Subject to any disclaimer, the term of this patent is extended or adjusted under 35 U.S.C. 154(b) by 0 days.

This patent is subject to a terminal disclaimer.

(21) Appl. No.: 15/758,780

(22) PCT Filed: Sep. 8, 2016

(86) PCT No.: PCT/FR2016/052252

§ 371 (c)(1),
(2) Date: Mar. 9, 2018

(87) PCT Pub. No.: WO2017/042500

PCT Pub. Date: Mar. 16, 2017

(65) Prior Publication Data

US 2019/0048552 A1 Feb. 14, 2019

(30) Foreign Application Priority Data

Sep. 10, 2015 (FR) ..... 15 58429

(51) Int. Cl.
*E02D 17/13* (2006.01)
*E02D 17/02* (2006.01)
(Continued)

(52) U.S. Cl.
CPC ..... *E02D 17/13* (2013.01); *E02D 17/02* (2013.01); *E02F 3/205* (2013.01); *E02F 3/241* (2013.01); *E02D 2600/40* (2013.01); *E21B 3/02* (2013.01)

(58) Field of Classification Search
CPC ..... E02D 17/13; E02D 17/02; E02D 2600/40; E02F 3/205; E02F 3/241; E21B 3/02
See application file for complete search history.

(56) References Cited

U.S. PATENT DOCUMENTS 3,554,603 A * 1/1971 Kampf-Emden et al. ..... E21D 9/1093 299/31
5,707,182 A * 1/1998 Leffer ..... E02D 17/13 405/267

(Continued)

FOREIGN PATENT DOCUMENTS

CA 2998309 A1 * 3/2017 ..... E02D 17/13
DE 2334591 1/1975

(Continued)

*Primary Examiner* — Jamie L McGowan
(74) *Attorney, Agent, or Firm* — Workman Nydegger; Matthew D. Todd

(57) ABSTRACT

A drilling machine (10) for making an excavation in ground in a drilling direction that is substantially vertical, the drilling machine including: an anchor module (22) having at least one anchor element for preventing the anchor module from moving relative to the walls of the excavation in the drilling direction, the anchor module having a longitudinal direction that is substantially vertical; a drilling module (12) provided with cutter members, the drilling module being movable in translation relative to the anchor module in the drilling direction; and a movement device (50) arranged between the anchor module and the drilling module in order to move the drilling module in translation relative to the anchor module in the drilling direction. The machine is suspended from a lift cable (70) that is fastened to the drilling module (12).

17 Claims, 7 Drawing Sheets

(51) Int. Cl.

| | |
|---|---|
| ***E02F 3/20*** | (2006.01) |
| ***E02F 3/24*** | (2006.01) |
| *E21B 3/02* | (2006.01) |

(56) References Cited

U.S. PATENT DOCUMENTS

| | | | | |
|---|---|---|---|---|
| 6,793,444 | B2 * | 9/2004 | Kondo | E02D 33/00 175/98 |
| 7,367,143 | B2 * | 5/2008 | Stoetzer | E02D 17/13 175/91 |
| 7,637,038 | B2 * | 12/2009 | Arzberger | E02F 3/205 299/34.11 |
| 7,661,209 | B2 * | 2/2010 | Arzberger | E02D 17/13 175/96 |
| 8,640,364 | B2 * | 2/2014 | Arzberger | E02D 17/13 37/189 |
| 2003/0074810 | A1 * | 4/2003 | Gessay | E02D 17/13 37/347 |

FOREIGN PATENT DOCUMENTS

| | | |
|---|---|---|
| DE | 3615068 | 10/1987 |
| DE | 10336315 | 3/2005 |
| EP | 2703564 | 3/2014 |

* cited by examiner

DRILLING MACHINE

BACKGROUND OF THE INVENTION

The present invention relates to the field of drilling in the ground, in particular for the purpose of constructing foundations, such as for example continuous screens made up of juxtaposed concrete wall elements.

The invention relates more precisely to a drilling machine for excavating in the ground in a drilling direction that is substantially vertical, and more particularly in hard soil.

The invention relates more particularly to a machine comprising:

an anchor module having at least one anchor element for preventing the anchor module from moving relative to the walls of the excavation in the drilling direction, the anchor module having a substantially vertical longitudinal direction;

a drilling module provided with cutter members, the drilling module being movable relative to the anchor module in the drilling direction; and a movement device arranged between the anchor module and the drilling module in order to move the drilling module relative to the anchor module in the drilling direction.

This type of drilling machine is generally used for drilling in hard ground, e.g. in granite. The movement device serves to exert additional thrust on the drilling tools, for the purpose of facilitating excavation.

Such a machine is described in particular in EP 0 811 724. It can be understood that the anchor module serves to hold the drilling machine stationary in the excavation.

In that machine, the movement device, constituted by jacks, supports the weight of the drilling module while the machine is suspended, i.e. while it is not in contact with the ground for drilling. This applies in particular while the drilling machine is being moved, e.g. in order to be taken to the zone for drilling, or indeed while it is being extracted from the excavation after the drilling operation.

The drilling module is particularly heavy when it has motor-driven cutter members, hydraulic circuits, and the pump member. It can thus be understood that the jacks need to support a weight that is very large when the drilling machine is suspended, which might damage them.

OBJECT AND SUMMARY OF THE INVENTION

An object of the present invention is to remedy the above-mentioned drawbacks by proposing a drilling machine that is more robust.

The invention achieves this object by the fact that the drilling machine of the invention is suspended from a lift cable that is fastened to a fastener portion of the drilling module.

In other words, in the invention, it is the drilling machine that is suspended from the lift cable, and not the anchor module as with the prior art drilling machine.

Insofar as the drilling module is generally heavier than the anchor module, it can be understood that the movement device supports only the weight of the anchor module while the drilling machine is suspended. The movement device is then stressed to a smaller extent, thus enabling its lifetime to be increased.

Another advantage of the invention is that in the event of the anchor module becoming jammed, the drilling module remains supported by the lift cable.

It can thus be understood that the lift cable is connected directly to the drilling machine, and indirectly to the anchor module via the drilling module and the movement device.

The drilling machine presents a deployed position in which the cutter members are remote from the anchor module, and a retracted position in which the cutter members are closer to the anchor module.

The term "substantially vertical" is used to mean a direction that makes an angle of absolute value that is less than or equal to 10° relative to the vertical.

Advantageously, the fastener portion extends above the anchor module.

By means of this configuration, the anchor module remains below the lift cable, thus making it possible to avoid damaging said cable.

In a preferred first embodiment, the drilling module presents a bottom section carrying the cutter members, and a top section extending in the longitudinal direction of the anchor module inside said anchor module, the fastener portion being arranged at the top end of the top section of the drilling module.

It can be understood that the top section projects beyond the top end of the anchor module.

In addition, the anchor module includes means for guiding the top section of the drilling module in translation along the longitudinal direction of the anchor module.

Preferably, the top section is a bar mounted to slide in the anchor module, said bar passing longitudinally through the anchor module. Preferably, but not exclusively, the bar extends above the top end of the anchor module.

In a preferred variant, the anchor module has two anchor elements arranged on either side of the bar, the anchor elements being connected to each other and extending in the longitudinal direction of the anchor module.

This advantageous configuration serves to reduce the weight of the anchor module. The two anchor elements are connected to each other by guide members in which the top section of the drilling module, in particular the bar, slides.

In a second embodiment, the drilling module presents a bottom section carrying the cutter members, and a top section surrounding the anchor module, the fastener portion being arranged at the top end of the top section of the drilling module.

It can thus be understood that the anchor module is arranged in the top section of the drilling module.

An advantage of this shape is that the drilling module then presents two wide opposite anchor faces, which can be preferable for ensuring grip in certain types of soil. Another advantage is to reduce the number of actuators needed for deploying the anchor elements.

In an advantageous aspect of the invention, the drilling module is mounted to pivot relative to the anchor module in a first vertical plane, and at least one of the bottom section and the top section includes path correction means for causing the drilling module to pivot relative to the anchor module in said first vertical plane.

To do this, the drilling module is preferably mounted relative to the anchor module with clearance suitable for accommodating such pivoting in the first vertical plane.

The path correction means thus enable the position of the drilling module relative to the anchor module to be modified in three dimensions in order to modify the position of the cutter members, thereby enabling the drilling path to be adjusted.

Such path adjustment by pivoting the drilling module is preferably performed after ensuring the anchor module is stationary in the excavation.

Preferably, the path correction means comprise deployable pads arranged on the front and rear faces of the bottom and/or top sections in order to bear against at least one of the walls of the excavation in order to cause the drilling module to pivot relative to the anchor module.

The front and rear faces of the bottom section and of the top section are those arranged facing the larger walls of the excavation.

It can be understood that when one of the deployable pads comes to bear against one of the walls of the excavation, it gives rise by reaction to the drilling module pivoting relative to the anchor module, and thus relative to the excavation.

Advantageously, the bottom section further comprises an anti-swinging device.

An advantage is to prevent the drilling module from swaying, thus making it possible to avoid the drilling path deviating from the desired path.

For this purpose, the anti-swinging device preferably comprises deployable pads configured to bear against at least one of the walls of the excavation in order to prevent the drilling module from pivoting in a second vertical plane that is orthogonal to the first vertical plane. The deployable pads are preferably arranged on the lateral sides of the bottom section of the drilling module.

Advantageously, the movement device comprises one or more thrust actuators arranged between the anchor module and the drilling module.

Preferably, the movement device is arranged between the anchor module and the bottom section of the drilling module.

Advantageously, the movement device includes damper means for damping the vibration generated by the cutter members of the drilling module when drilling.

Preferably, but not exclusively, damping is performed hydraulically by means of a hydraulic damper device. Preferably, but not exclusively, the damper device comprises a spring accumulator with at least one nozzle. In the event of an impact, the oil contained in one of the chambers of the hydraulic thrust actuator is compressed and flows through the nozzle towards the spring accumulator in order to damp the pressure rise of the oil, thus performing damping. Preferably, the leakage flow rate through the nozzle and the prestress of the spring accumulator are adjustable, thereby making it possible to adjust the damping coefficient and the resistance to reversing of the actuators as a function of the weight applied on the cutter members.

Alternatively, the damper means comprise one or more springs associated with the thrust actuators.

Advantageously, the anchor element includes at least one front anchor pad and at least one rear anchor pad, the front and rear anchor pads being deployable in a transverse direction that is transverse relative to the longitudinal direction of the anchor module, so as to bear against the walls of the excavation in order to prevent the anchor module from moving in the ground.

Preferably, the anchor pads are deployed by actuators, such as hydraulic actuators, arranged in the anchor module.

Advantageously, the drilling machine is a milling machine in which the cutter members comprise two pairs of drums that are rotatable about axes of rotation that are parallel, distinct, and perpendicular to the drilling direction.

It is specified that the above-mentioned first vertical plane is then parallel to the axes of rotation, while the second vertical plane is orthogonal to the axes of rotation.

In order to discharge the excavated soil, the drilling module further includes a spoil suction device comprising a pump member arranged in the bottom portion of the drilling module and a discharge pipe connected to the pump member and extending inside the drilling module to a top end of the drilling module situated above the anchor module.

Having the drilling module suspended from the lift cable has the advantageous effect of making it easier to integrate hoses in the drilling machine, and in particular the spoil discharge pipe.

When the drilling module has a top section in the form of a bar, the discharge pipe extends inside said bar.

BRIEF DESCRIPTION OF THE DRAWINGS

The invention can be better understood on reading the following description of embodiments of the invention given as non-limiting examples and with reference to the accompanying drawings, in which.

DETAILED DESCRIPTION OF THE INVENTION

Figure 1:
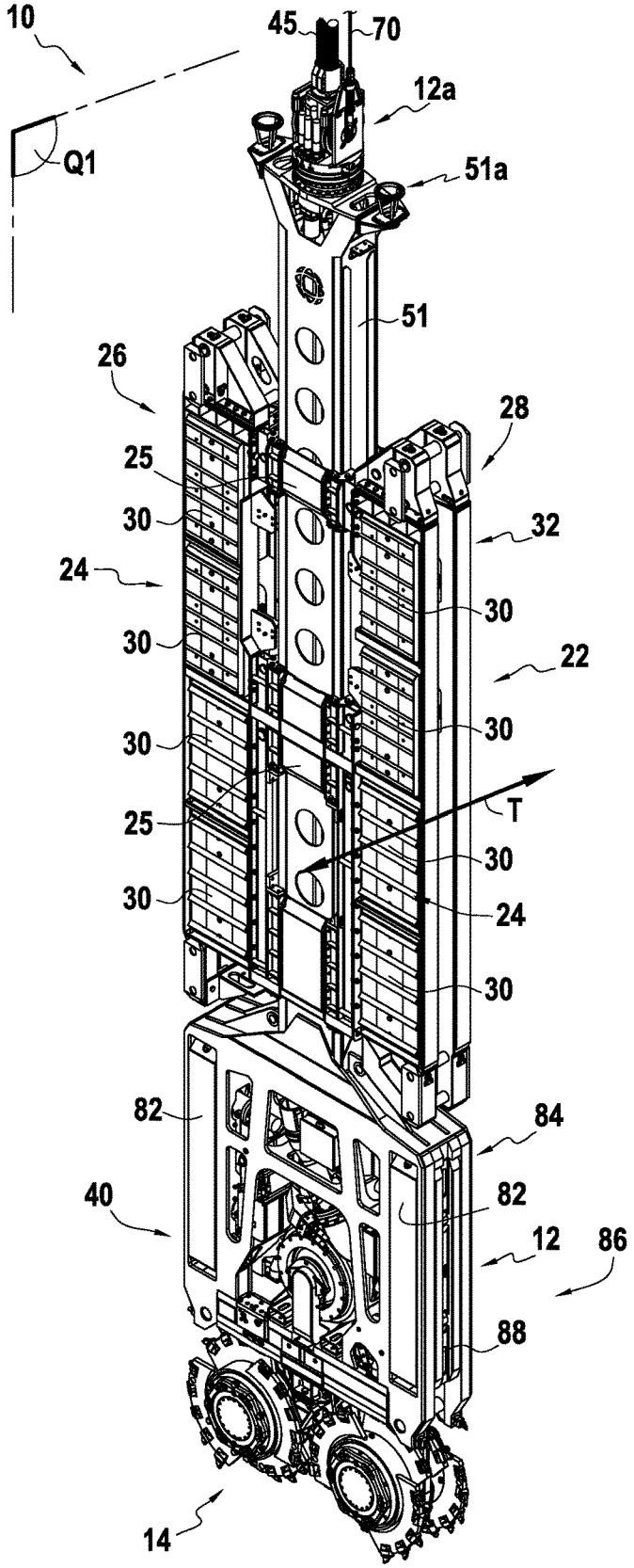
FIG. 1 is a perspective view of a first embodiment of the drilling machine of the invention.
Figure 2A:
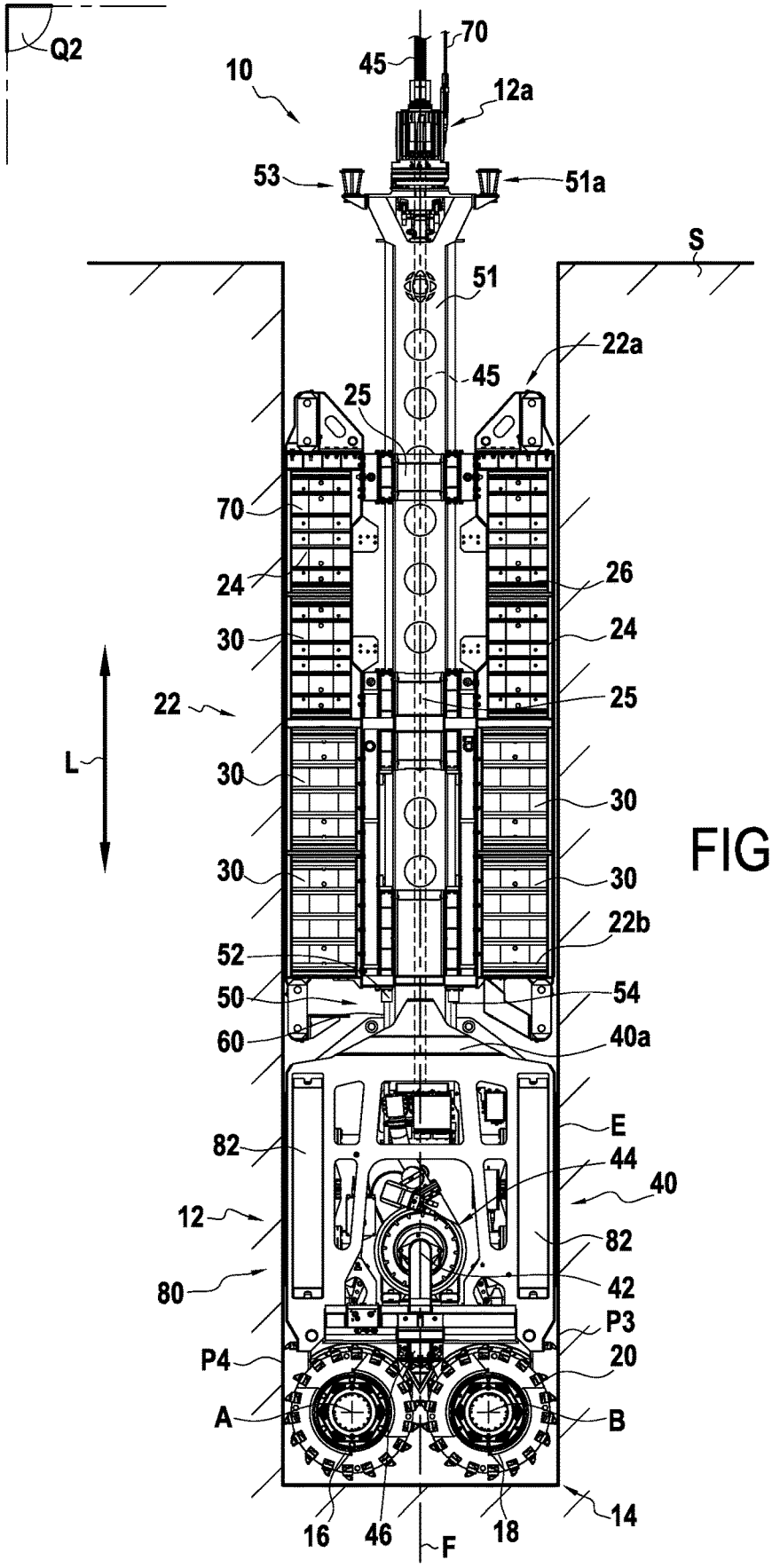
FIG. 2A is a face view of the FIG. 1 drilling machine, the drilling module being in the retracted position.
Figure 2B:
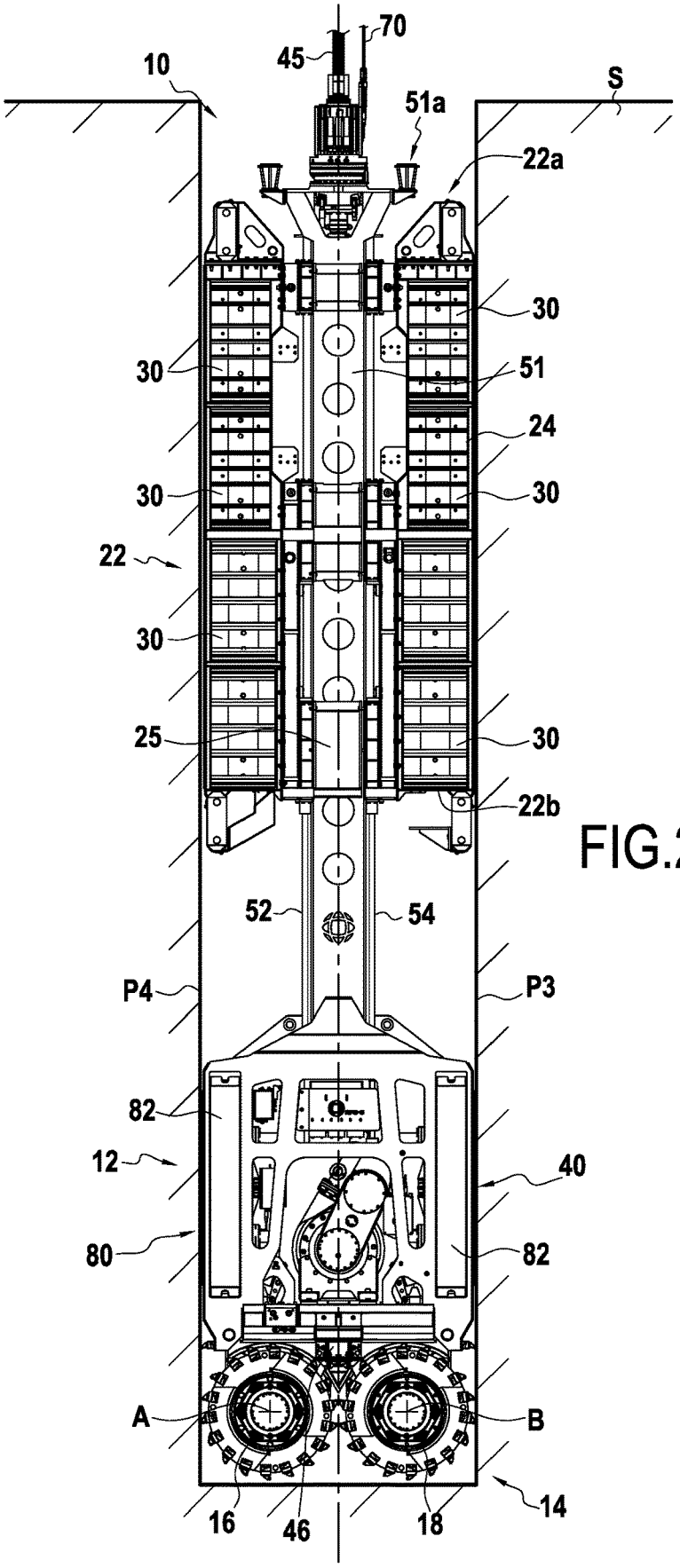
FIG. 2B is a face view of the FIG. 2A drilling machine in the deployed position.

With reference to FIGS. 1, 2A, and 2B, the description begins with a first embodiment of a drilling machine 10 in accordance with the present invention. The drilling machine 10 is designed to make an excavation E in ground S along a drilling direction F that is substantially vertical. In other words, the drilling machine 10 of the invention is designed to make vertical trenches in the ground. The drilling machine 10 has a drilling module 12 that is provided with cutter members 14 that, in this example, comprise two pairs of drums 16, 18 that rotate about axes of rotation A, B that are parallel, distinct, and perpendicular to the drilling direction F. The pairs of drums 16 and 18 carry cutter teeth referenced 20. In this example, it can be understood that the drilling machine 10 is a milling machine.

The drilling machine 10 also has an anchor module 22 located above the cutter members 14 and that presents a longitudinal direction L that is substantially vertical. The anchor module 22 has anchor elements 24 that serve to prevent movement of the anchor module 22 relative to the walls of the excavation E in the drilling direction F. In other words, when they are actuated, the anchor elements hold the anchor module stationary in the ground. In the first embodiment, the anchor module 22 has two anchor elements 24, each anchor element comprising four front anchor pads 30 and four rear anchor pads 32. It can be understood that the front anchor pads 30 are arranged on the front face 26 of the anchor module 22, while the rear anchor pads 32 are arranged on the rear face 28 of the anchor module 22.

The front and rear anchor pads 30, 32 can be deployed in a transverse direction T that extends transversely relative to the longitudinal direction L of the anchor module, so as to bear against the two opposite larger walls P1, P2 of the excavation E, thereby preventing the anchor module 22 from moving in the ground S. For this purpose, the anchor pads are deployed by actuators arranged in the anchor module.

With reference once more to FIG. 2A, it can be seen that the drilling module 12 presents a bottom section 40 that is arranged under the anchor module 22 and that carries the cutter members 14 together with a pump member 42 and a spoil suction device 44. The pump member 42 has a nozzle 46 that opens out between the two pairs of drums 16, 18 in order to suck in fragments of excavated ground.

The drilling module 12 also has a top section 51 that is in the form of a longitudinal bar extending vertically, and that extends from a top end 40*a* of the bottom section 40.

As can be seen in FIGS. 1, 2A, and 2B, the top section 51 in the form of a bar extends along the longitudinal direction L of the anchor module inside said anchor module 22. More precisely, the top section 51 in the form of a bar passes longitudinally through the anchor module 22, and projects above the top end 22*a* of the anchor module 22.

It can also be seen that the two anchor elements 24 are arranged on opposite sides of the bar-shaped top section 51.

Furthermore, the drilling module 12 is movable in translation relative to the anchor module along the drilling direction F, i.e. in a direction that is substantially vertical. The drilling module can thus go from a retracted position, as shown in FIG. 2A, in which the cutter members 14 are close to the anchor module 22, to a deployed position, shown in FIG. 2B, in which the cutter members 14 are further away from the anchor module.

For this purpose, the drilling machine 10 has a movement device 50, specifically hydraulic thrust actuators 52, 54 that are arranged between the anchor module 22 and the drilling module 12 in order to move the drilling module in translation relative to the anchor module in the drilling direction. More precisely, the movement device 50, constituted by the thrust actuators 52 and 54, is arranged between the bottom end 22*b* of the anchor module and the top end 40*a* of the bottom section 40 of the drilling module 12.

It can thus be understood that the effect of actuating the thrust actuators 52, 54 is to move the drilling module 12 relative to the anchor module 22 in translation along the drilling direction F. In particular, when the anchor module is stationary in the ground, the effect of actuating the thrust actuators is to exert thrust on the cutter members 14 that is directed in the drilling direction F.

The spoil suction device 44 also has a discharge pipe 45 that is connected to the pump member 42 and that extends inside the drilling module, and more precisely inside the bar-shaped top section 51 as far as the top end of the drilling module 12 that is situated above the anchor module 22. This discharge pipe 45 serves to discharge the excavated spoil towards a spoil treatment station situated on the surface.

In the example of FIG. 2A, the movement device 50 also has damper means 60 for damping the vibration generated by the cutter members 14 of the drilling module while drilling.

Figure 8:
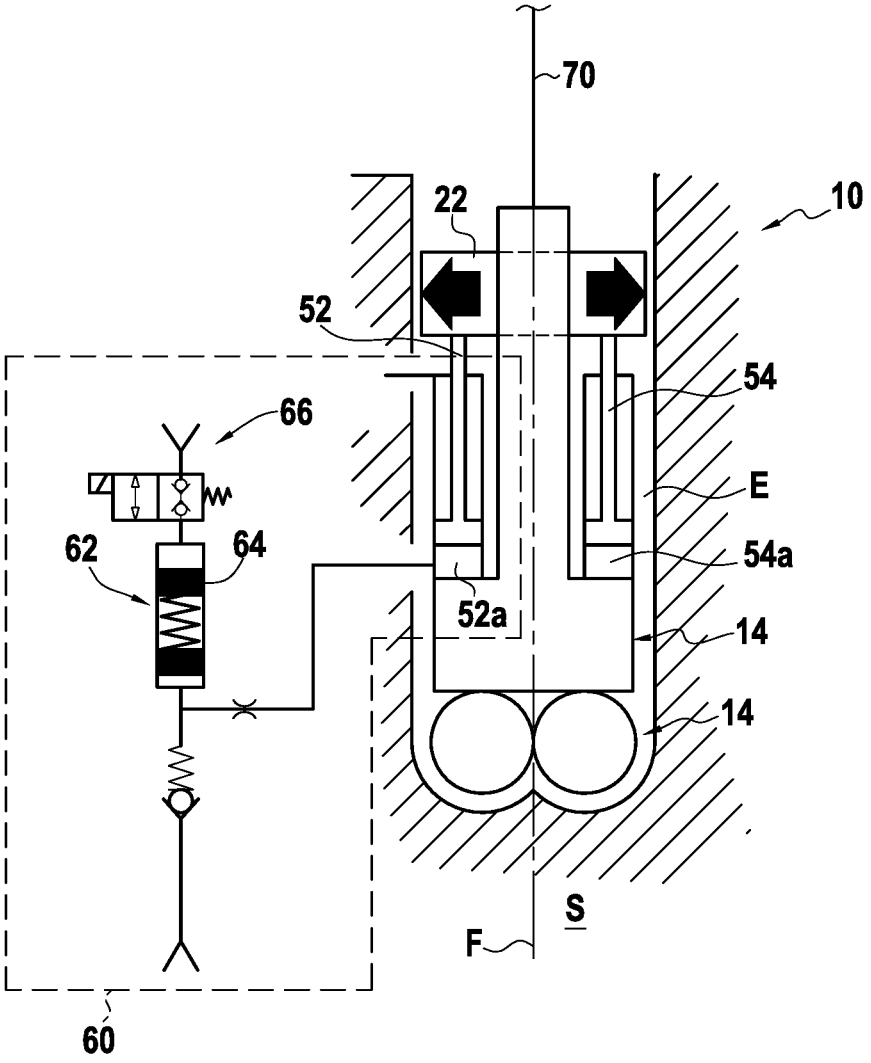
FIG. 8 shows an example of hydraulic damper means.

The damper means 60 are shown in FIG. 8. They comprise a hydraulic damper device 62 that is in fluid flow connection with the hydraulic thrust actuators 52, 54. In this example, the hydraulic damper device preferably includes a spring accumulator 64 with at least one nozzle. When the cutter members 14 are subjected to an impact, oil contained in one of the chambers 52*a*, 54*a* of the hydraulic thrust actuators 52, 54 is compressed and flows through the nozzle to the spring accumulator 64 in order to damp the pressure rise in the oil, thereby performing damping. The damper means 60 also include a device 66 for regulating the damping coefficient of the damper means, and more precisely the damping coefficient of the spring accumulator 64. Thus, during an impact, the vibration generated by the cutter members is not transmitted to the anchor module 22.

The leakage flow rate through the nozzle and the prestress of the spring in the accumulator are preferably remotely adjustable.

In accordance with the invention, the drilling machine 10 is suspended from a lift cable 70 that is fastened to a fastener portion 53 of the drilling module 12. In this example, the fastener portion 53 is arranged at the top end of the drilling module. In known manner, the lift cable 70 serves to suspend the drilling machine 10 from a hoist (not shown).

More precisely, in this first embodiment, the lift cable 70 is fastened to a top end 51*a* of the top section 51 of the drilling module 12. It can be seen that this top end 51*a* of the top section 51 of the drilling module 12 forms the fastener portion 53 that extends above the anchor module 22 and to which the lift cable 70 is fastened.

As can be seen in FIG. 2A, the two anchor elements 24 are connected to each other by connection members 25 that also constitute means for providing guidance in translation to the bar-shaped top section 51. The connection members 24 form sheaths in which the bar-shaped top section 51 is mounted to slide in the drilling direction.

When considered in the transverse direction T, parallel to the deployment direction of the anchor pads, clearance is left between the top section 51 and the connection members 25 so that the anchor module 12 can pivot relative to the anchor module 22, with this pivoting taking place in a first vertical plane Q1 that is parallel to the axes of rotation A and B of the drums. This first vertical plane Q1 is shown in FIG. 1. It is specified that the pivoting of the drilling module 12 relative to the anchor module 22 is of the order of a few degrees and serves to modify the position of the cutter members 14 in order to correct the drilling path, should that be necessary.

Figure 6:
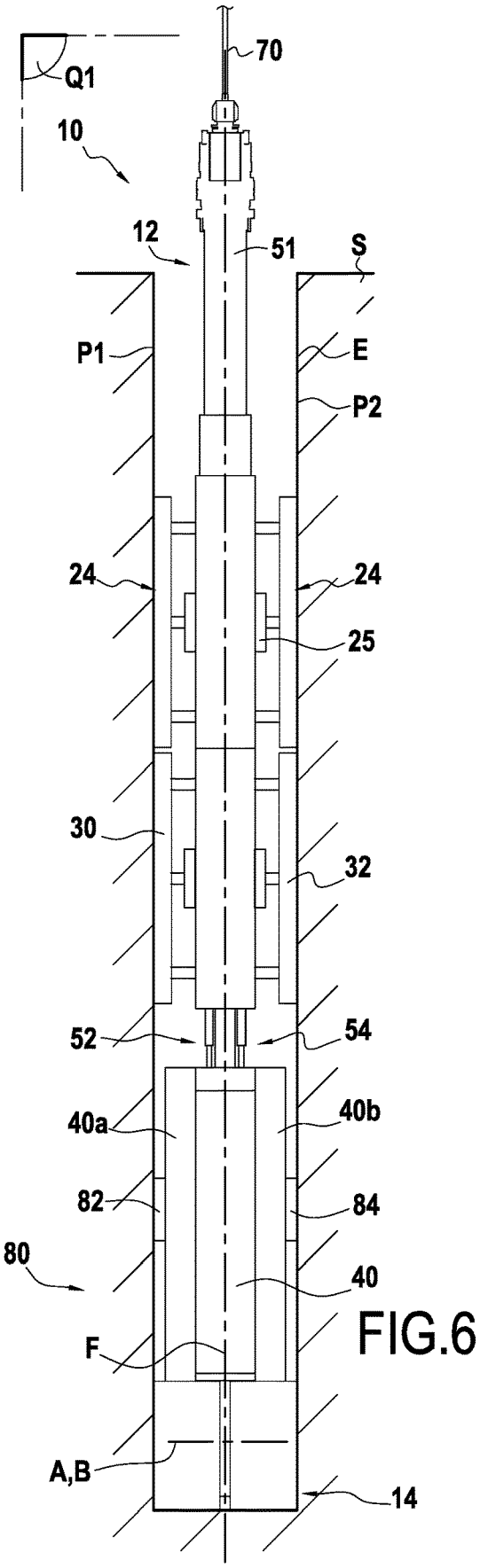
FIG. 6 is a diagrammatic illustration of the drilling machine of the invention in side view during drilling, while the anchor module is being held stationary in the ground.
Figure 7:
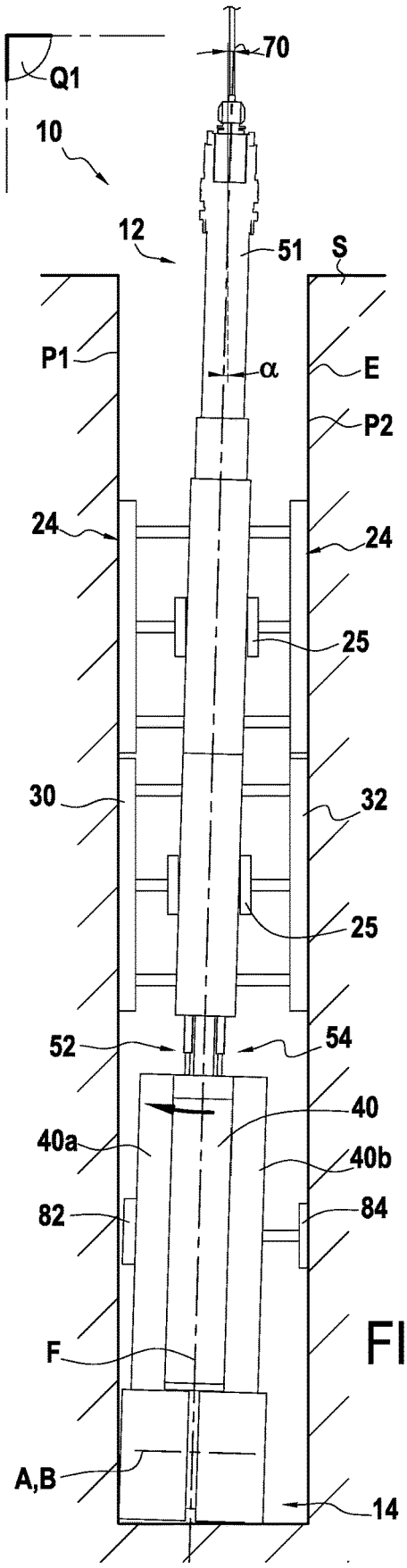
FIG. 7 is an illustration of the FIG. 6 drilling machine in which the drilling module is inclined relative to the anchor module.

FIGS. 6 and 7 are diagrams showing the drilling machine of the invention in side view, and the description below explains how the drilling module 12 is pivoted relative to the anchor module 22. The bottom section 40 of the drilling module 12 has path correction means 80 that serve to cause the drilling module to pivot relative to the anchor module in the first vertical plane Q1. For this purpose, these path correction means comprise deployable pads 82, 84 that are arranged on the front face 40*a* and on the rear face 40*b* of the bottom section 40 of the drilling module.

The deployable pads 82, 84 are configured to bear against one or the other of the larger walls P1, P2 of the excavation E in order to cause the drilling module to pivot relative to the anchor module.

In the example of FIG. 7, it is the deployable pad 84 of the rear face of the bottom section 40 of the drilling module that is actuated to bear against the wall P2. In reaction, the drilling module 12 pivots in the first vertical plane Q1 so that the cutter members 14 move towards the opposite wall P1 of the excavation. Insofar as clearance exists between the connection members 25 and the top section of the drilling module, it can be understood that the drilling module can be tilted a little relative to the anchor module, thus making it possible to adjust the positions of the cutter members 14.

Naturally, in FIG. 7, the pivot angle α is exaggerated in order to make the invention easier to understand.

It is also specified that the drilling module 12 can be pivoted relative to the anchor module 22 while the anchor module is held stationary in the ground S as a result of the anchor elements 24 being actuated so that the anchor pads 30 and 32 are deployed.

In another example utilization, the drilling module is caused to pivot initially in order to correct the drilling path, and then the anchor module is held stationary in the ground, after which the cutter members are actuated.

In order to avoid the drilling machine 10 swinging at the end of the lift cable 70 in a vertical plane Q2 that is orthogonal to the first vertical plane Q1, the bottom section 40 also has an anti-swinging device 86. As shown diagrammatically in FIG. 1, the anti-swinging device 86 comprises deployable lateral pads 88 that are configured to bear against one or other of the smaller walls P3, P4 that are orthogonal to the larger walls P1, P2. It can be understood that actuating the deployable lateral pads serves to stabilize the drilling module so that it does not present any swinging movement in the second vertical plane Q2.

Figure 3:
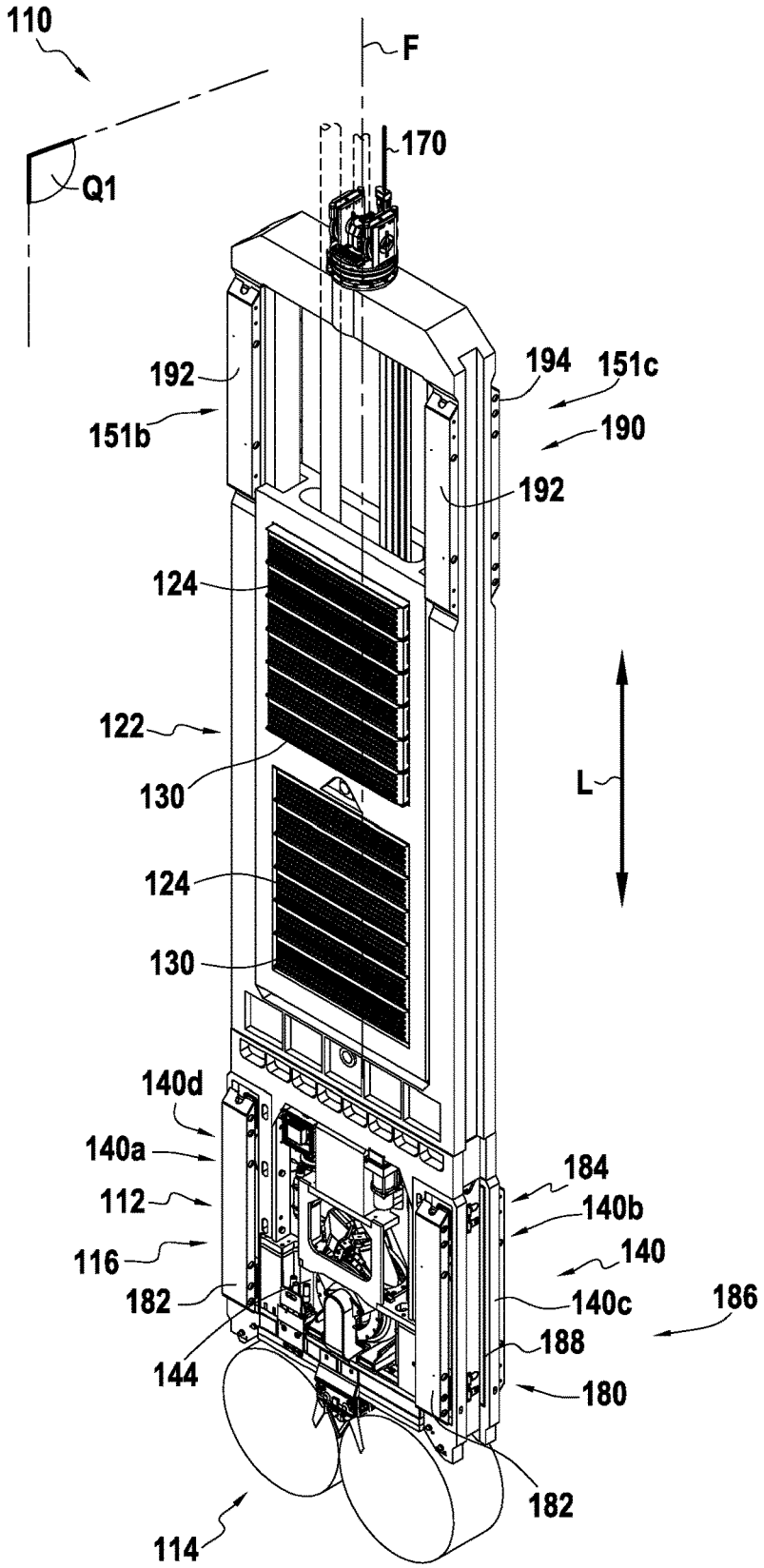
FIG. 3 is a perspective view of a second embodiment of the drilling machine of the invention, the drilling module being in the retracted position.
Figure 4:
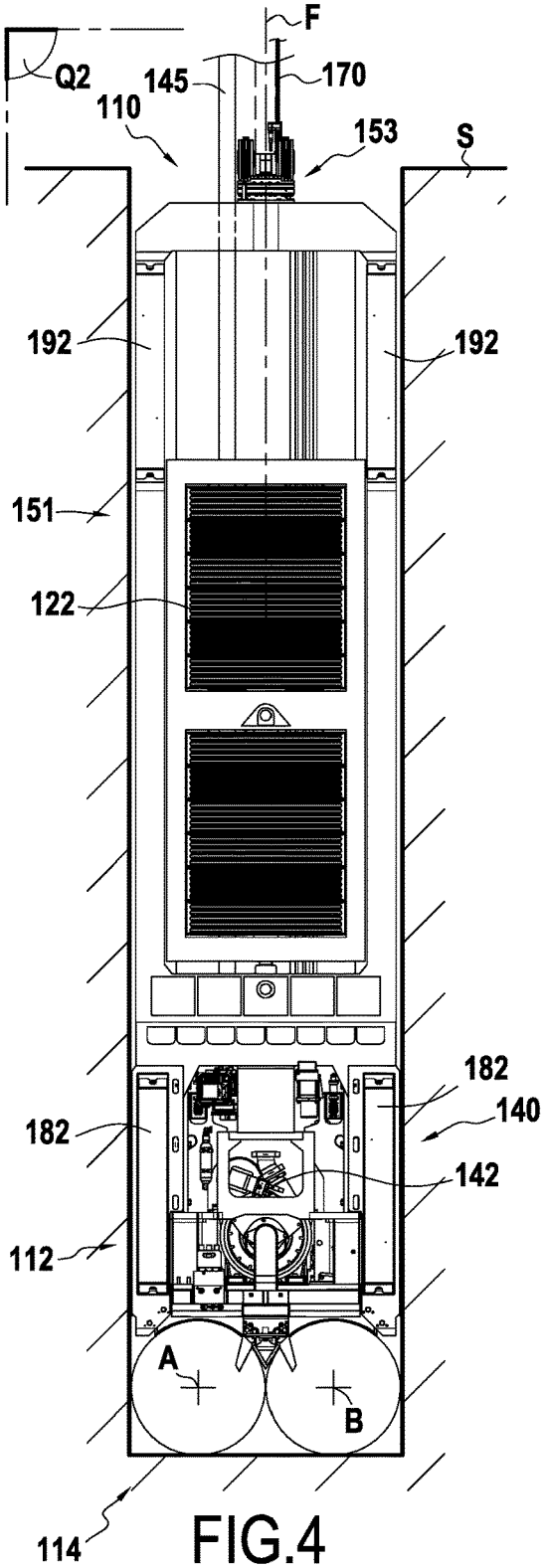
FIG. 4 is a face view of the FIG. 3 drilling machine, the drilling module being in the retracted position.
Figure 5:
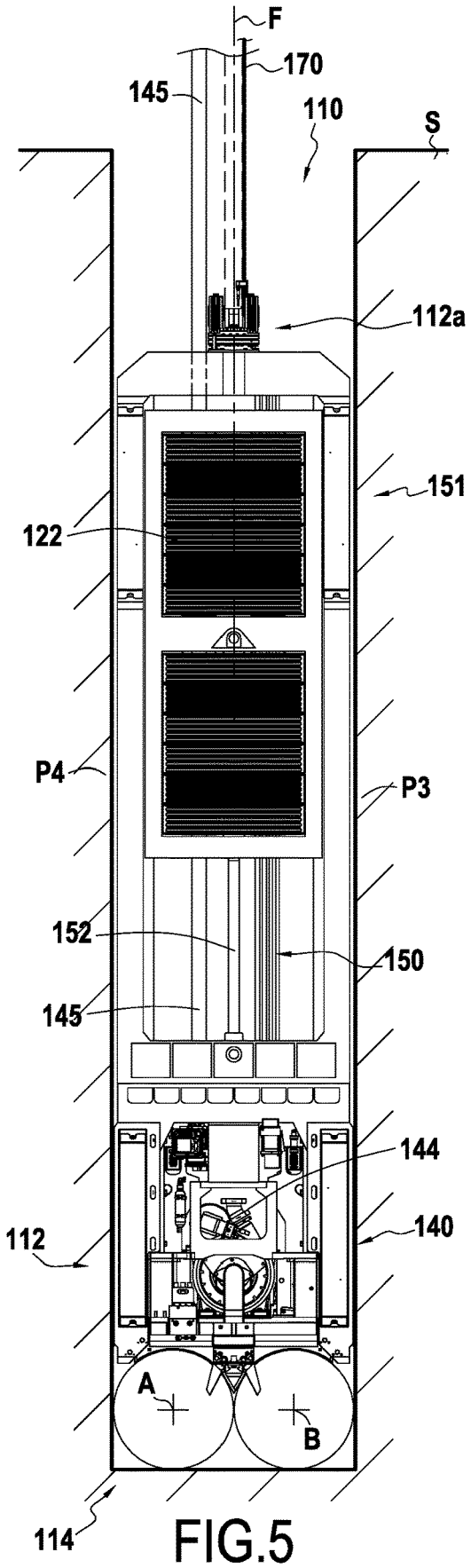
FIG. 5 is a face view of the FIG. 3 drilling machine, the drilling module being in the deployed position.

With reference to FIGS. 3 to 5, there follows a description of a second embodiment of the drilling machine 110 of the invention. Technical features shared in common with the first embodiment are given the same references plus 100.

The drilling machine 110 comprises a drilling module 112 having cutter members 114. The drilling machine 110 also comprises an anchor module 122 that extends in a substantially vertical longitudinal direction L and that is provided with two anchor elements 124 for preventing the anchor module 122 from moving relative to the walls of the excavation E in the drilling direction F, which is likewise substantially vertical.

The anchor elements comprise front anchor pads 130 and rear anchor pads (not shown) that are arranged on each of the larger front and rear faces of the anchor module. These anchor pads are deployable so as to bear against the larger walls P1, P2 of the excavation in order to prevent the anchor module from moving in the ground S.

The drilling module 112 is also provided with cutter members 114, the drilling module being movable in translation relative to the anchor module along the drilling direction F. In this second embodiment, the drilling module 112 presents a bottom section 140 that carries the cutter members 114 together with a top section 151 that extends above the bottom section 140. In particular manner, in this second embodiment, the top section 151 presents a structure that surrounds the anchor module 122.

From FIGS. 4 and 5, it can be understood that the anchor module 122 is mounted to slide inside the top section 151 of the drilling module. The drilling module 112 is moved relative to the anchor module by a movement device 150 (visible in FIG. 5) that has a single thrust actuator 152. This thrust actuator 152 is arranged between the anchor module 122 and the bottom section 140 of the drilling module 112. FIG. 4 shows the drilling machine in the retracted position, while FIG. 5 shows the drilling machine in the deployed position, the thrust actuator 152 itself being deployed such that the cutter members 114 are further away from the anchor module 122.

The drilling machine 110 in the second embodiment of the invention is also suspended from a lift cable 170 that is fastened to a fastener portion 153 of the drilling module that is arranged at a top end 112*a* of the drilling module 112. The fastener portion 153 extends above the anchor module 122, the lift cable 170 thus being fastened to said fastener portion 153.

The drilling module 112 is also mounted with clearance relative to the anchor module 122. Consequently, as in the first embodiment, the drilling module 112 of the drilling machine in the second embodiment is likewise pivotally mounted relative to the anchor module 122. This pivoting takes place in a similar manner to that shown in FIG. 7.

In order to perform such pivoting, the bottom section 140 has first path correction means 180 that comprise front bottom deployable pads 182 on the front face 140*a* and rear bottom deployable pads 184 on the rear face 140*b*. In addition, the top section 151 has second path correction means 190 that comprise front top deployable pads 192 arranged on the front face 151*b* and rear top deployable pads 194 arranged on the rear face 151*c* of the top section of the drilling module.

These deployable pads 182, 184, 192, 194 are configured to bear against one or the other of the larger walls P1, P2 of the excavation E so as to cause the drilling module to pivot relative to the anchor module in the first vertical plane Q1. It can be understood that the front bottom deployable pads 182 of the bottom section 140 of the drilling module are actuated together with the rear top deployable pads 194 arranged on the rear face of the top section 151 so as to facilitate pivoting the drilling module relative to the anchor module in a first direction. Conversely, the rear bottom deployable pads 184 of the bottom section 140 are actuated together with the front top deployable pads 192 of the front face of the top section 151 of the drilling module likewise so as to facilitate pivoting of the drilling relative to the anchor module in a second pivot direction, opposite to the first direction.

It can also be understood that the pivot axis of the drilling module is horizontal and is situated substantially between the deployable pads 192, 194 of the top section and the deployable pads 182, 184 of the bottom section.

The bottom section 140 of the drilling module also has an anti-swinging device 186 comprising deployable lateral pads 188 arranged along the lateral sides of the bottom section 140, these deployable lateral pads being configured to bear against one or the other of the smaller walls P3, P4 of the excavation. It is specified that the lateral sides 140*c*, 140*d* of the bottom section 140 are contiguous with the front and rear faces of said bottom section 140.

The drilling machine 110 in the second embodiment has damper means similar to those of the first embodiment, as shown in FIG. 8.

Like the first embodiment, the drilling machine 110 in the second embodiment is likewise a milling machine having cutter members 114 that comprise two pairs of drums 116, 118 provided with cutter teeth that rotate about axes of rotation A, B that are parallel, distinct, and perpendicular to the drilling direction F.

The drilling module 112 also has a spoil suction device 144 that comprises a pump member 142 arranged in the bottom portion of the drilling module and a discharge pipe 145 for discharging the spoil.

The discharge pipe 145 is connected to the pump member 142, and it extends inside the drilling module and the anchor module to a top end of the drilling module that is situated above the anchor module, the discharge pipe 145 passing through the fastener portion 153.

The invention claimed is:

1. A drilling machine for making an excavation in ground in a drilling direction that is substantially vertical, said drilling machine comprising:

an anchor module having at least one anchor element for preventing the anchor module from moving relative to the walls of the excavation in the drilling direction, the anchor module having a longitudinal direction;

a drilling module provided with cutter members comprising two pairs of drums that are rotatable about axes of rotation that are parallel, distinct and perpendicular to the drilling direction, the drilling module being movable in translation relative to the anchor module in the drilling direction, the drilling module further including a spoil suction device comprising a pump member and a discharge pipe connected to the pump member and extending inside the drilling module to a top end of the drilling module situated above a top of the anchor module; and a movement device arranged between the anchor module and the drilling module in order to move the drilling module in translation relative to the anchor module in the drilling direction;

wherein the drilling machine is suspended from a lift cable that is fastened to a fastener portion of the drilling module.

2. The drilling machine according to claim 1, wherein the fastener portion extends above the anchor module.

3. The drilling machine according to claim 1, wherein the drilling module presents a bottom section carrying the cutter members, and a top section extending in the longitudinal direction of the anchor module inside said anchor module, the fastener portion being arranged at the top end of the top section of the drilling module.

4. The drilling machine according to claim 3, wherein the top section is a bar mounted to slide in the anchor module, said bar passing longitudinally through the anchor module.

5. The drilling machine according to claim 4, wherein the anchor module has two anchor elements arranged on either side of the bar, the anchor elements being connected to each other and extending in the longitudinal direction of the anchor module.

6. The drilling machine according to claim 1, wherein the drilling module presents a bottom section carrying the cutter members, and a top section surrounding the anchor module, the fastener portion being arranged at the top end of the top section of the drilling module.

7. The drilling machine according to claim 3, wherein the drilling module is mounted to pivot relative to the anchor module in a first vertical plane, and wherein at least one of the bottom section or the top section includes a path correction device for causing the drilling module to pivot relative to the anchor module in said first vertical plane.

8. The drilling machine according to claim 7, wherein the path correction device comprises deployable pads arranged on the front and rear faces of the bottom and/or top sections in order to bear against at least one of the walls of the excavation in order to cause the drilling module to pivot relative to the anchor module.

9. The drilling machine according to claim 7, wherein the bottom section further comprises an anti-swinging device.

10. The drilling machine according to claim 9, wherein the anti-swinging device comprises deployable lateral pads configured to bear against at least one of the walls of the excavation so as to cause the drilling module to pivot in a second vertical plane that is orthogonal to the first vertical plane.

11. The drilling machine according to claim 1, wherein the movement device comprises one or more thrust actuators arranged between the anchor module and the drilling module.

12. The drilling machine according to claim 1, wherein the movement device includes a damper device for damping the vibration generated by the cutter members of the drilling module when drilling.

13. The drilling machine according to claim 1, wherein the anchor element includes at least one front anchor pad and at least one rear anchor pad, the front and rear anchor pads being deployable in a transverse direction that is transverse relative to the longitudinal direction of the anchor module, so as to bear against the walls of the excavation in order to prevent the anchor module from moving in the ground.

14. A drilling machine for making an excavation in ground in a drilling direction that is substantially vertical, said drilling machine comprising:

an anchor module having at least one anchor element for preventing the anchor module from moving relative to the walls of the excavation in the drilling direction, the anchor module having a longitudinal direction;

a drilling module provided with cutter members, the drilling module being movable in translation relative to the anchor module in the drilling direction;

a movement device arranged between the anchor module and the drilling module in order to move the drilling module in translation relative to the anchor module in the drilling direction;

wherein the drilling machine is suspended from a lift cable that is fastened to a fastener portion of the drilling module;

wherein the drilling module presents a bottom section carrying the cutter members, and a top section extending in the longitudinal direction of the anchor module inside said anchor module, the fastener portion being arranged at the top end of the top section of the drilling module;

wherein the drilling module is mounted to pivot relative to the anchor module in a first vertical plane, and wherein at least one of the bottom section or the top section includes a path correction device for causing the drilling module to pivot relative to the anchor module in said first vertical plane.

15. The drilling machine according to claim 14, wherein the path correction device comprises deployable pads arranged on the front and rear faces of the bottom and/or top sections in order to bear against at least one of the walls of the excavation in order to cause the drilling module to pivot relative to the anchor module.

16. The drilling machine according to claim 14, wherein the bottom section further comprises an anti-swinging device.

17. The drilling machine according to claim 16, wherein the anti-swinging device comprises deployable lateral pads configured to bear against at least one of the walls of the excavation so as to cause the drilling module to pivot in a second vertical plane that is orthogonal to the first vertical plane.

* * * * *